US008379902B2

(12) United States Patent
Koseki

(10) Patent No.: US 8,379,902 B2
(45) Date of Patent: Feb. 19, 2013

(54) AUDIO OUTPUT CONTROL DEVICE, AUDIO OUTPUT CONTROL METHOD, AND PROGRAM

(75) Inventor: Koji Koseki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 790 days.

(21) Appl. No.: 12/535,625

(22) Filed: Aug. 4, 2009

(65) Prior Publication Data

US 2010/0027832 A1 Feb. 4, 2010

(30) Foreign Application Priority Data

Aug. 4, 2008 (JP) ..... 2008-200460

(51) Int. Cl.
*H04R 1/02* (2006.01)

(52) U.S. Cl. ..... 381/387; 381/388

(58) Field of Classification Search ..... 381/387; 340/815.4; 705/26.1
See application file for complete search history.

(56) References Cited

U.S. PATENT DOCUMENTS

| | | | | |
|---|---|---|---|---|
| 7,367,423 | B2 * | 5/2008 | Ferrell et al. | 181/187 |
| 2003/0088832 | A1 * | 5/2003 | Agostinelli et al. | 715/526 |
| 2004/0119602 | A1 * | 6/2004 | Blum et al. | 340/815.4 |
| 2005/0212822 | A1 | 9/2005 | Honma et al. | |

FOREIGN PATENT DOCUMENTS

| | | | |
|---|---|---|---|
| JP | 11345262 | A | 12/1999 |
| JP | 2002204492 | A | 7/2002 |
| JP | 2004226494 | A | 8/2004 |
| JP | 2005011097 | A | 1/2005 |

* cited by examiner

*Primary Examiner* — Curtis Kuntz
*Assistant Examiner* — Sunita Joshi
(74) *Attorney, Agent, or Firm* — Nutter McClennen & Fish LLP; John J. Penny, Jr.; Christina M. Sperry

(57) ABSTRACT

Attention can be effectively called to an advertisement, and the effect of calling attention can be known. A control device is connected to a super-directional speaker that outputs audio in a specific direction, and a speaker pedestal that adjusts the audio output direction of the super-directional speaker. The control device takes a picture of an area in front of an advertisement display surface by means of a camera, detects a person photographed in the image captured by the imaging unit as a target, adjusts the audio output direction of the super-directional speaker to the direction of the target by means of the speaker pedestal, and causes the super-directional speaker to output audio. After outputting the audio, the control device takes another picture by the camera, and again determines the direction in which the face of the target is looking based on this picture.

14 Claims, 7 Drawing Sheets

33

| ADVERTISING IMAGE | TIMES DETECTED | TARGET ATTRIBUTES | AUDIO DATA |
|---|---|---|---|
| ADVERTISING IMAGE A | 1 | MALE, 20 - 30 | AUDIO DATA A1 |
| | | FEMALE, 20 - 30 | AUDIO DATA A2 |
| | | MALE, 40 - 50 | AUDIO DATA A3 |
| | | FEMALE, 40 - 50 | AUDIO DATA A4 |
| | | MALE, OVER 60 | AUDIO DATA A5 |
| | | FEMALE, OVER 60 | AUDIO DATA A6 |
| | 2 | MALE, 20 - 30 | AUDIO DATA B1 |
| | | FEMALE, 20 - 30 | AUDIO DATA B2 |
| | | MALE, 40 - 50 | AUDIO DATA B3 |
| | | FEMALE, 40 - 50 | AUDIO DATA B4 |
| | | MALE, OVER 60 | AUDIO DATA B5 |
| | | FEMALE, OVER 60 | AUDIO DATA B6 |
| ⋮ | ⋮ | ⋮ | ⋮ |

FIG. 4

34

| ID | ATTRIBUTES (AGE, SEX) | FEATURE INFORMATION | AUDIO DATA | ATTENTION FLAG | IMAGE CAPTURE TIME |
|---|---|---|---|---|---|
| 001 | FEMALE, 20 - 30 | ····· | AUDIO DATA A2 | OFF | 18:00 |
| 002 | MALE, OVER 60 | ····· | AUDIO DATA A5 | OFF | 18:02 |
| 003 | MALE, 20 - 30 | ····· | AUDIO DATA B1 | ON | 18:44 |
| ⋮ | ⋮ | ⋮ | ⋮ | ⋮ | ⋮ |

FIG. 5

AUDIO OUTPUT CONTROL DEVICE, AUDIO OUTPUT CONTROL METHOD, AND PROGRAM

This application claims priority under 35 U.S.C. §119 to Japanese Patent Application No. 2008-200460 filed on Aug. 4, 2008, the entire disclosure of which is expressly incorporated by reference herein.

BACKGROUND

1. Technical Field

The present invention relates to an audio output control device, an audio output control method, and a program for controlling audio output from a directional speaker.

2. Related Art

Methods of presenting advertisements according to the related art include displaying posters and displaying advertisements on a display device mounted on a wall, for example. To improve the effectiveness of advertisements presented on such display devices, Japanese Unexamined Patent Appl. Pub. JP-A-2004-226494 teaches rotating a horizontally long display device that is normally used in a landscape orientation 90 degrees and presenting advertisements on the display device in this vertically long or portrait mode orientation.

While attracting attention to an advertisement can effectively improve the advertising effect, there is a limit to how much attention can be gained with visual effects, and it is extremely difficult to get people that have not even noticed an advertisement to focus their attention on the advertisement. A means of effectively attracting and focusing attention on an advertisement is therefore desired.

In addition to methods of increasing the advertising effect, a means of accurately determining how effective a particular method of attracting attention is is also strongly desired.

SUMMARY

An object of the present invention is therefore to effectively attract attention to an advertisement, and to know the effect of calling attention to the advertisement.

A first aspect of the invention is an audio output control device that is connected to a directional speaker that outputs audio in a specific direction, and an audio output direction adjustment mechanism that adjusts the audio output direction of the directional speaker, the audio output control device including: an imaging unit that images a specific range from an advertisement display surface; a target detection unit that detects a person photographed in the image captured by the imaging unit as a target; an audio output control unit that causes the audio output direction adjustment mechanism to direct the audio output direction of the directional speaker toward the target detected by the target detection unit, and causes the directional speaker to output audio; and an orientation detection unit that determines the orientation of the face of the target based on an image captured by the imaging unit after the directional speaker outputs audio as controlled by the audio output control unit.

Because this aspect of the invention outputs audio from a directional speaker to a target person within a specific range from the advertisement display surface, and determines the orientation of the face of the target after the audio is output, attention can be called to an advertisement by outputting audio, and how much attention the target pays to the advertisement after the audio output can be determined.

Furthermore, by using a directional speaker, the audio can be output so that it can be heard only by a very small number of people, and attention to the advertisement can be called more strongly than if the audio is output so that it can be heard by anyone within a wide range. It is therefore possible to both attract attention to an advertisement by means of audio output using a directional speaker, and whether the audio output actually attracted any attention to the advertisement can be known.

Preferably, the audio output control device also has an attention time detection unit that determines the time the face of the target was facing toward the advertisement display surface after the orientation detection unit determines the face of the target is facing the advertisement display surface.

This aspect of the invention determines for how long the target paid attention to the advertisement display surface after looking at the advertisement display surface after the audio was output from the directional speaker, and can therefore attract attention to the advertisement by means of audio while also enable knowing specifically the effect the audio output had on the target.

Further preferably, the audio output control unit selects from among people in the image captured by the imaging unit a person whose face is not facing the advertisement display surface as the target.

Because this aspect of the invention outputs audio from a directional speaker to people that are not looking at the advertisement display surface as the intended target, and then determines if the target faced the advertisement display surface, an audio appeal can be made by the directional speaker to substantially only those people that are not looking at the advertisement, and the attention of those people can be called to the advertisement. Whether attention was actually directed to the advertisement can also be determined.

Yet further preferably, the imaging unit images a specific range from the display surface of a display device that displays an advertising image as the advertisement display surface, and the audio output control unit outputs audio related to the advertising image displayed by the display device.

This aspect of the invention can more strongly call attention to the advertisement by using a directional speaker to output audio related to the advertising image to people within a specific range from the display surface of the display device on which the advertising image is displayed. The appeal of the advertisement can thus be improved, and the effect of audio output on the advertising effect can be known.

Another aspect of the invention is an audio output control method for an audio output control device that is connected to a directional speaker that outputs audio in a specific direction, and an audio output direction adjustment mechanism that adjusts the audio output direction of the directional speaker, the audio output control method including steps of imaging an area in front of an advertisement display surface; detecting a person photographed in the captured image as a target; causing the audio output direction adjustment mechanism to direct the audio output direction of the directional speaker toward the target detected by the target detection unit, and causing the directional speaker to output audio; and capturing another image after the directional speaker outputs audio and determining the orientation of the face of the target based on this captured image.

Because this aspect of the invention outputs audio from a directional speaker to a target person within a specific range from the advertisement display surface, and determines the orientation of the face of the target after the audio is output, attention can be called effectively to an advertisement by outputting audio, and whether the target paid to the advertisement after the audio was output can be determined. It is therefore possible to both attract attention to an advertisement by means of audio output using a directional speaker, and whether the audio output actually attracted any attention to the advertisement can be known.

An audio output control method according to another aspect of the invention preferably also determines how long the target looked toward the advertisement display surface after the orientation detection unit determines the face of the target faced the advertisement display surface.

An audio output control method according to another aspect of the invention selects a person whose face is not facing the advertisement display surface as the target from among the people in the image captured by the imaging unit.

An audio output control method according to yet another aspect of the invention preferably also has steps of imaging a specific range from the display surface of a display device that displays an advertising image as the advertisement display surface, and outputting audio related to the advertising image displayed by the display device.

Another aspect of the invention is a program that is executed by a computer connected to a directional speaker that outputs audio in a specific direction, and an audio output direction adjustment mechanism that adjusts the audio output direction of the directional speaker, the program causing the computer to function as: an imaging unit that images a specific range from an advertisement display surface; a target detection unit that detects a person photographed in the image captured by the imaging unit as a target; an audio output control unit that causes the audio output direction adjustment mechanism to direct the audio output direction of the directional speaker toward the target detected by the target detection unit, and causes the directional speaker to output audio; and an orientation detection unit that determines the orientation of the face of the target based on an image captured by the imaging unit after the directional speaker outputs audio as controlled by the audio output control unit.

Because a computer executing the program according to this aspect of the invention outputs audio from a directional speaker to a target person within a specific range from the advertisement display surface, and determines the orientation of the face of the target after the audio is output, attention can be called effectively to an advertisement by outputting audio, and whether the target paid to the advertisement after the audio was output can be determined. It is therefore possible to both attract attention to an advertisement by means of audio output using a directional speaker, and whether the audio output actually attracted any attention to the advertisement can be known.

EFFECT OF THE INVENTION

The invention can thus strongly call attention to an advertisement by outputting audio using a super-directional speaker to people within viewing range of the advertisement, and can know the effect of audio output on the effect of the advertisement.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 4 shows an example of the structure of an audio selection table.

FIG. 5 shows an example of target audience history information.

DESCRIPTION OF EMBODIMENTS

A preferred embodiment of the present invention is described below with reference to the accompanying figures.

Figure 1:
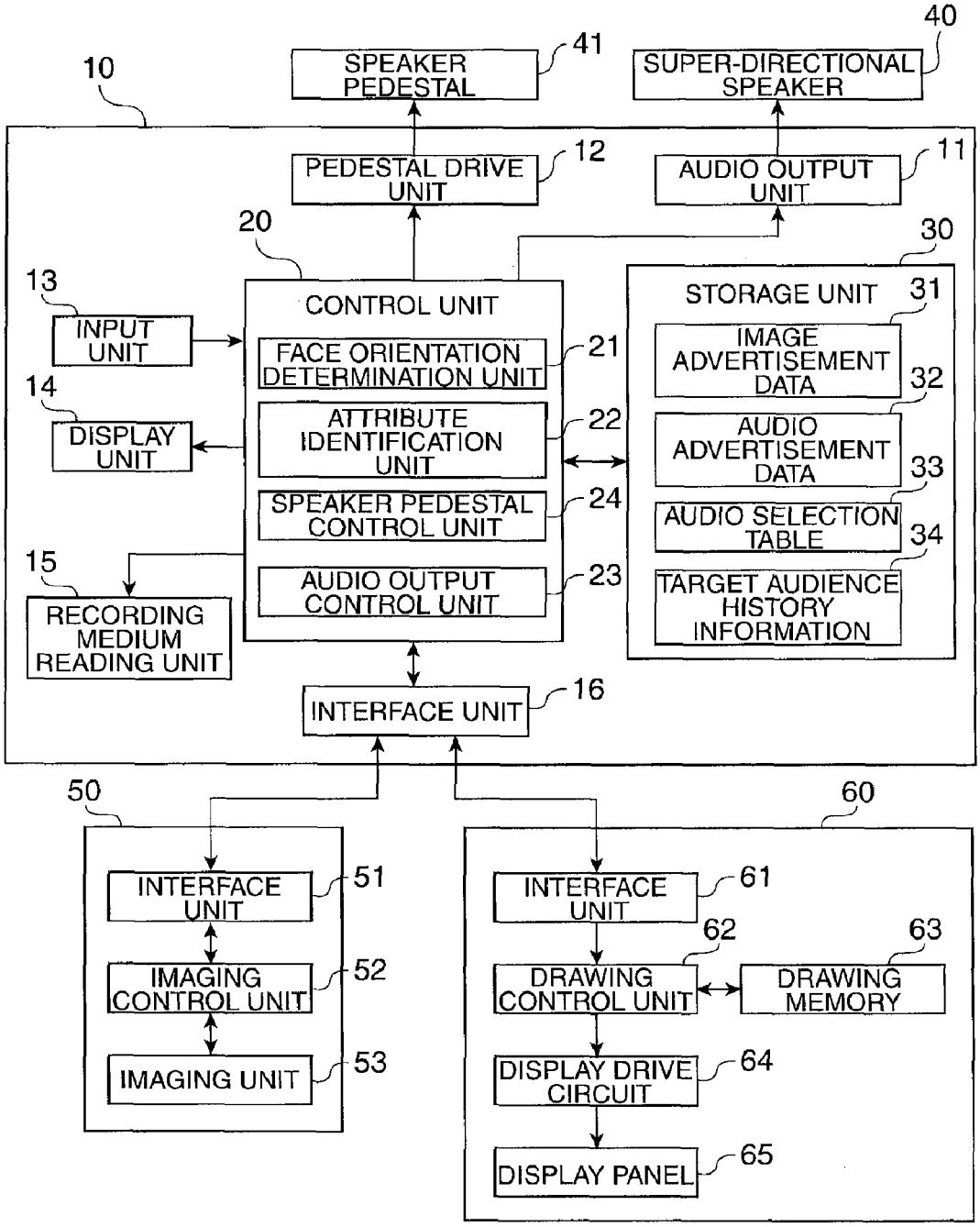
FIG. 1 is a function block diagram showing the configuration of an audio output system.

FIG. 1 is a block diagram showing the functional configuration of an audio output system 1 according to a preferred embodiment of the invention.

This audio output system 1 has a super-directional speaker 40, a camera 50, and a display device 60 each connected to a control device 10.

The audio output system 1 described below as an audio output device uses the display device 60 to display an image of an advertisement for a product or service, for example, uses the camera 50 to image the area in which the advertisement displayed on the display device 60 can be viewed, detects a person in this area based on the captured image, and outputs audio from the super-directional speaker 40 directed to the detected person.

The super-directional speaker 40 is a speaker with high directivity, such as a parametric speaker, and outputs audio that can only be heard by the person located in the direction of audio output or only by a few people, including that person, that are near that person. More specifically, an ultrasonic speaker that has an ultrasonic transducer and outputs a modulated wave produced by modulating an ultrasonic frequency carrier wave produced by the ultrasonic transducer with an audio signal in the audible frequency band is used as the super-directional speaker 40.

The super-directional speaker 40 is supported by a speaker pedestal 41. The speaker pedestal 41 is a stand on which the super-directional speaker 40 is mounted, and functions as an audio output direction adjustment mechanism that adjusts the direction of the audio output from the super-directional speaker 40. In this embodiment of the invention the speaker pedestal 41 has one or a plurality of movable axes (not shown in the figure), and a motor (not shown in the figure) that changes the orientation of the super-directional speaker 40 around these axes. As described below, the control device 10 can control operation of the speaker pedestal 41 to change the direction in which the audio output from the super-directional speaker 40 is projected as desired.

The camera 50 can capture still pictures and/or video images, operates as controlled by the control device 10, and outputs the captured image data to the control device 10.

The camera 50 has an interface unit 51 enabling connection to the control device 10, an imaging control unit 52, and an imaging unit 53.

The imaging unit 53 has an imaging device such as a CCD image sensor or CMOS (not shown in the figure), a photographic lens group (not shown in the figure), and a lens drive unit (not shown in the figure) for driving the lens group to zoom or adjust the focus, for example, and takes pictures as controlled by the imaging control unit 52.

The imaging control unit 52 causes the lens drive unit of the imaging unit 53 to operate and render specific imaging conditions according to the control signal input through the interface unit 51. The data output from the imaging device of the imaging unit 53 under these conditions is converted to data of a specific format, and outputs the resulting image data through the interface unit 51.

The interface unit 51 is connected to the control device 10 through a physical cable or a wireless connection, receives and outputs control signals input from the control device 10 to the imaging control unit 52, and outputs the captured image data input from the imaging control unit 52 to the control device 10.

The display device 60 displays advertising images (still pictures or video) as controlled by the control device 10.

The display device 60 has an interface unit 61 connected to the control device 10, a drawing control unit 62 that acquires display signals input through the interface unit 61, drawing memory 63 connected to the drawing control unit 62, a display drive circuit 64 that drives the display panel 65 as controlled by the drawing control unit 62, and a display panel 65.

The drawing control unit 62 draws the image to be displayed based on the display signal input from the control device 10 through the interface unit 61. The drawing control unit 62 reads the image from drawing memory 63 at the display panel 65 write timing, and outputs to the display drive circuit 64. The display drive circuit 64 drives the display panel 65 based on the image input from the drawing control unit 62 and displays the image.

The display panel 65 may be a liquid crystal display, a plasma display, an organic EL display, or other type of flat panel display device. If the display panel 65 uses a transmission LCD panel, the display device 60 has a backlight (not shown in the figure). The display drive circuit 64 drives the display panel 65, controls output by the backlight, and causes the backlight to turn on at the specified timing. If the display panel 65 is an emission display panel such as a plasma display panel or an organic EL display panel, a backlight is not needed.

Figure 2:
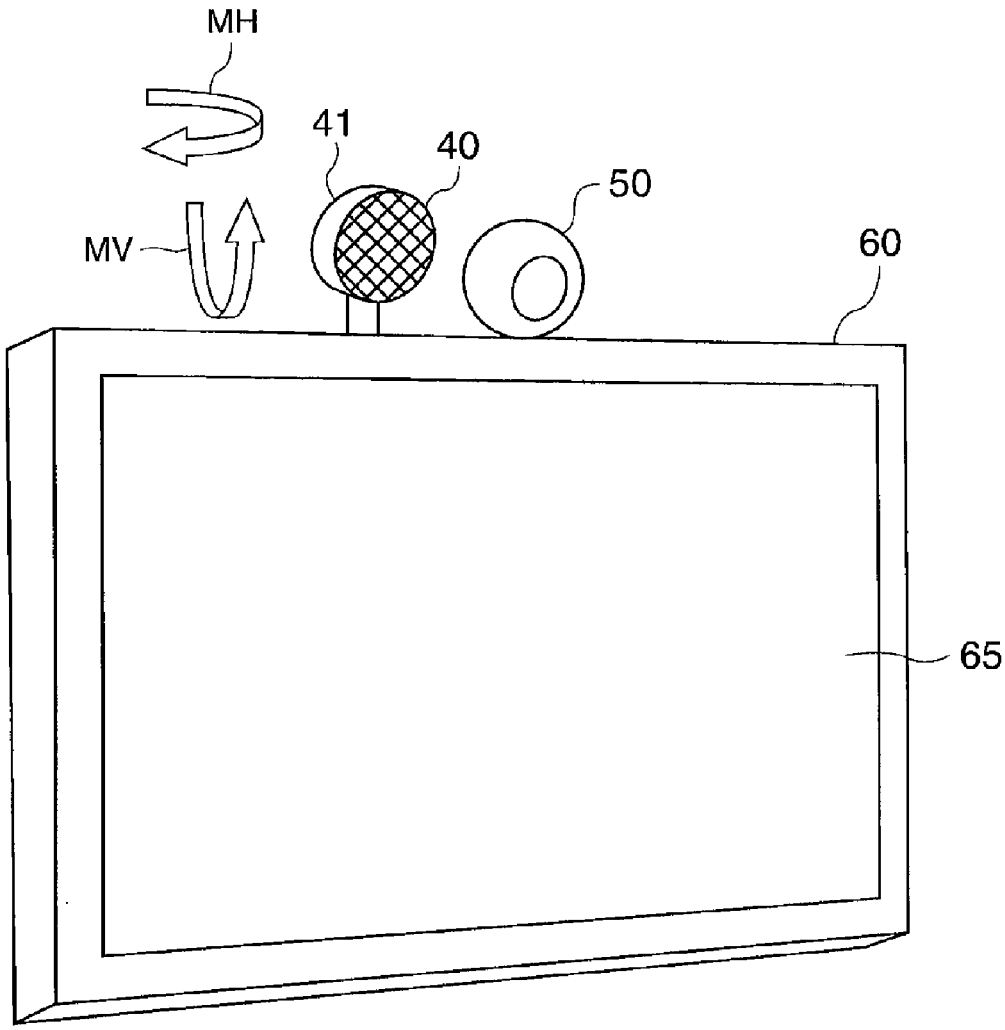
FIG. 2 is an oblique view showing the set up of a super-directional speaker and camera.
Figure 3:
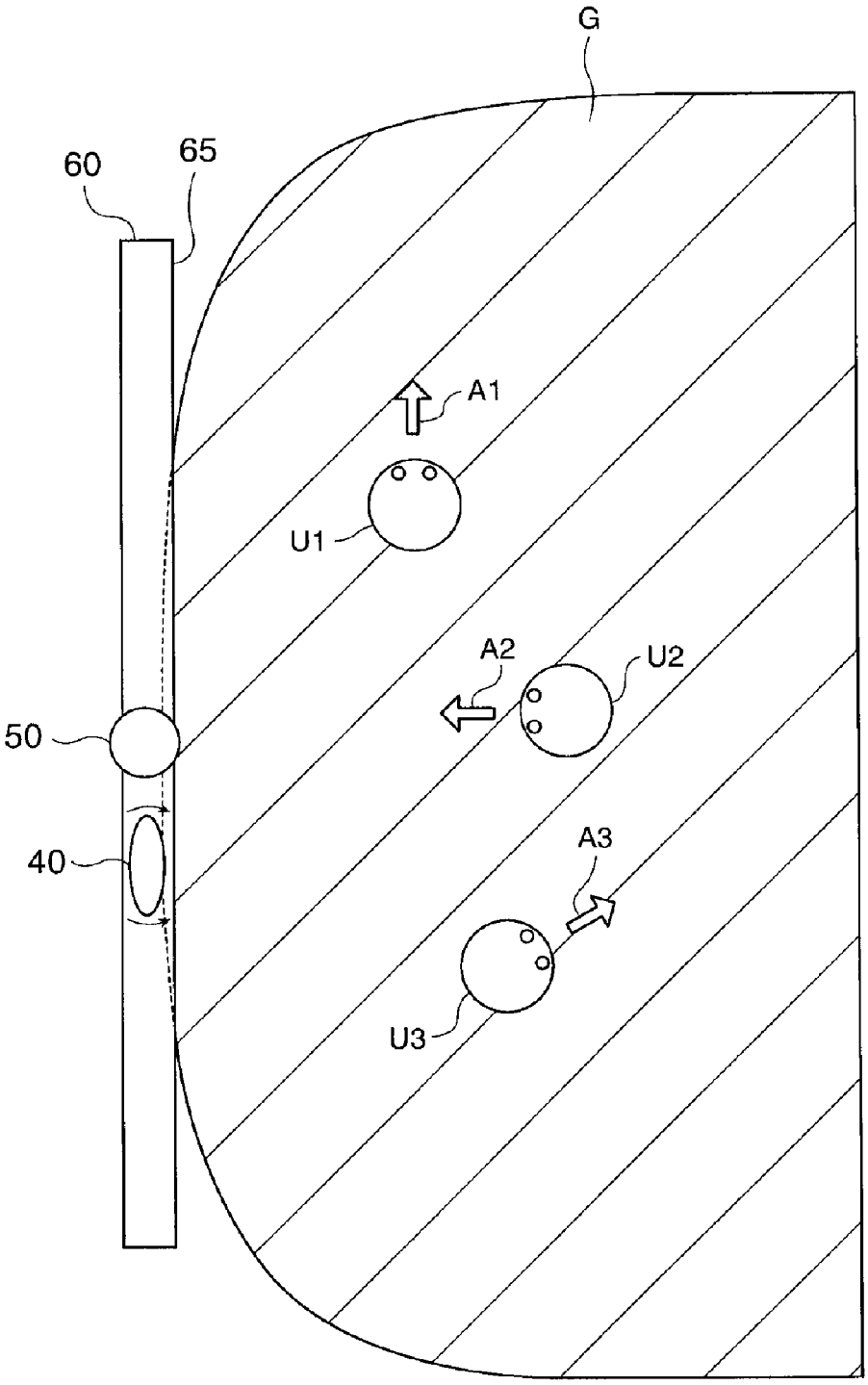
FIG. 3 is a plan view showing the imaging range of the camera.

FIG. 2 is an oblique view showing the set up of the super-directional speaker 40 and camera 50. FIG. 3 is a plan view showing the imaging area of the camera 50.

As shown in FIG. 2, the super-directional speaker 40 and camera 50 are disposed to the top of the display device 60.

The super-directional speaker 40 is disposed so that the audio output direction is primarily directed in front of the display panel 65. In this embodiment of the invention the speaker pedestal 41 has two mutually perpendicular axes of rotation, and audio output from the super-directional speaker 40 can be adjusted horizontally as denoted by arrow MH and vertically as denoted by arrow MV. The range of speaker pedestal 41 movement is not particularly limited, but in a typical application enables the audio output direction of the super-directional speaker 40 to be changed left and right and up and down centered on the front of the display panel 65 as denoted by arrow MH and arrow MV. The audio output direction of the super-directional speaker 40 changes in the direction of arrow MV according to the distance from the display panel 65 to the target to whom the audio is directed, and changes in the direction of arrow MH according to where the target is located on the right-left axis.

As shown in FIG. 2 and FIG. 3, the camera 50 used as the imaging unit is disposed to image the area in front of the display panel 65 including the front of the display panel 65 as the advertisement display surface. The imaging range of the camera 50 is the shaded area G in FIG. 3. This is an area within a specific range of the advertisement display surface, and more specifically is the area in which the advertising image displayed on the display panel 65 can be seen. The camera 50 is located so that it can photograph people positioned where the display panel 65 can be viewed. If the audio output system 1 uses only one camera 50, the camera 50 preferably uses a wide angle lens with a focal length of 24-35 mm, a superwide angle lens with a focal length of 21 mm or less, or a fisheye lens so that it can capture images through a wide range. Note that all focal lengths are equivalent to lenses for a 35 mm film camera.

The camera 50 is further preferably located substantially in the center of the display panel 65 as shown in FIG. 2 and FIG. 3.

If the audio output system 1 has a plurality of cameras 50 and the control device 10 processes the images captured by the different cameras 50 to eliminate image overlap, each of the cameras 50 may cover only a portion of the range G shown in FIG. 3. In this configuration the cameras 50 can function sufficiently using a normal wide angle lens.

If the audio output system 1 uses only one super-directional speaker 40, the range of horizontal movement of the speaker pedestal 41 is increased so that it can move, for example, 180 degrees or more horizontally as indicated by arrow MH.

Note that the height where the super-directional speaker 40 and camera 50 are installed is not limited to the top of the display device 60, and they may be located at a higher position. The super-directional speaker 40 and camera 50 are preferably located at a high elevation so that the camera 50 can efficiently image the entire range G and so that a specific person in this range G can reliably be made to hear the audio output from the super-directional speaker 40.

The control device 10 that controls the other parts of the audio output system 1 may be rendered using a personal computer, for example, and functions as an audio output control device. As shown in FIG. 1, the control device 10 has an audio output unit 11, a pedestal drive unit 12, an input unit 13, a display unit 14, a recording medium reading unit 15, an interface unit 16, a control unit 20 that controls the other parts of the control device 10, and a storage unit 30.

The audio output unit 11 is connected to the super-directional speaker 40, generates audio signals for outputting audio related to the audio data stored in the storage unit 30 as controlled by the control unit 20, and outputs this audio signal to the super-directional speaker 40.

The pedestal drive unit 12 supplies a drive signal and power for driving the motor (not shown in the figure) of the speaker pedestal 41 as controlled by the control unit 20. The pedestal drive unit 12 causes the motor to turn a specific angle based on the power and drive signal output to the speaker pedestal 41 so that the audio output direction of the super-directional speaker 40 is oriented in the direction controlled by the control unit 20.

The input unit 13 is connected to a mouse, keyboard, or other input device, detects operation of the input device, and outputs a corresponding operating signal to the control unit 20.

The display unit 14 displays information as controlled by the control unit 20, and is rendered using an LCD panel, for example.

The recording medium reading unit 15 is a device for reading programs and data from an optical disc recording medium such as a CD, DVD, or next-generation DVD, magneto-optical recording media such as MO discs, magnetic recording media, storage devices using semiconductor storage devices, recording devices using magnetic recording media, or other type of recording medium. The recording medium reading unit 15 reads data relating to images presented on the display panel 65, data relating to audio output from the super-directional speaker 40, and process data and programs executed by the control unit 20, for example, as controlled by the control unit 20, and outputs to the control unit 20. The data and programs read by the recording medium reading unit 15 are stored in the storage unit 30 as controlled by the control unit 20.

The interface unit 16 is connected by wire or wirelessly to the interface unit 51 of the camera 50 and the interface unit 61 of the display device 60. The interface unit 16 enables input and output of control signals, display information, and image data through the interfaces 51 and 61.

The control unit 20 provides centralized control of the other parts of the control device 10, and includes a CPU, ROM for nonvolatile storage of process data and the basic control program executed by the CPU, RAM for temporarily storing process data and programs executed by the CPU, and related peripheral circuits. The control unit 20 controls the other parts of the control device 10 by reading and running the basic control program stored in ROM. The control unit 20 also controls the functions of the control device 10 by controlling the other parts connected to the control device 10 as a result of reading and executing programs stored in ROM and the storage unit 30.

More specifically, the control unit 20 has function units including a face orientation determination unit 21 (target audience detection unit, orientation determination unit), an attribute identification unit 22, an audio output control unit 23, and a speaker pedestal control unit 24. These function units are achieved by the CPU of the control unit 20 executing a specific program.

The face orientation determination unit 21 runs a process that analyzes the captured image data input from the camera 50 and determines which way each person captured in the picture by the camera 50 is looking (that is, the orientation of their face). The face orientation determination unit 21 more particularly at least determines if the face of each person is looking towards the display panel 65.

As shown in FIG. 3, the camera 50 can photograph the people in the viewing range G, and if three people U1, U2, and U3 are in the viewing range G, for example, the faces of the three people U1, U2, and U3 are captured in the picture taken by the camera 50. As shown in FIG. 3, the face of person U1 is looking in direction A1, the face of person U2 is looking in direction A2, and the face of person U3 is looking in direction A3. In the example in FIG. 3 person U1 is looking to the side relative to the display panel 65, person U3 is looking diagonally away from the display panel 65, and person U2 is looking directly at the display panel 65.

Because the camera 50 images the area in front of the display panel 65 from the same side as the display screen of the display panel 65, that is, the area from which the display panel 65 can be seen (viewing range G), a front view of the face of the person U2 looking at the display panel 65 is captured in the picture taken by the camera 50.

The face orientation determination unit 21 determines the orientation of the face by detecting the outline of each person in the image captured by the camera 50 and determining if the face of each person is captured in a frontal view. Note that the face orientation determination unit 21 is not limited to determining if the face of each person is looking straight at the display panel 65, and may alternatively determine the orientation and approximate angle of each face that is looking to the side or an at angle to the display panel 65 or is looking away from the display panel 65.

The attribute identification unit 22 executes a process that interprets the captured image data input from the camera 50 and determines certain attributes of each person captured in the image data from the camera 50. The attribute identification unit 22 at least determines if the face of each person in the picture is looking toward the display panel 65.

The attribute identification unit 22 detects the outline of each person in the image captured by the camera 50, and detects certain features in selected parts of each person's outline. Examples of these features include the percentage of the image occupied by the person's hairdo, the color of hair and skin, the height and width of the person and the ratio therebetween, facial features, and the color of clothing. Based on the detected image features, the attribute identification unit 22 also determines the sex and age as other personal attributes.

From among the people in the picture captured by the camera 50, the audio output control unit 23 selects the target audience (people that are not facing the displayed advertisement) to whom the audio is to be directed by the super-directional speaker 40 based on the orientation of the face of each person identified by the face orientation determination unit 21 and the attributes of each person identified by the attribute identification unit 22. The audio output control unit 23 then selects the audio to be directed to the target person based on a audio selection table 33 stored in the storage unit 30, reads the selected audio data from the audio advertisement data 32, and outputs an audio signal for outputting the selected audio from the audio output unit 11 to the super-directional speaker 40.

In order to make the target audience selected by the audio output control unit 23 hear the audio from the super-directional speaker 40, the speaker pedestal control unit 24 calculates the direction and distance the speaker pedestal 41 is to be driven based on the location of the target audience in the image captured by the camera 50, and controls the pedestal drive unit 12 based on the result to operate the speaker pedestal 41.

This operation of the audio output control unit 23 and speaker pedestal control unit 24 causes audio to be output from the super-directional speaker 40 to specific people (target audience) selected from among the people in the picture taken by the camera 50.

The storage unit 30 is a storage device that uses a magnetic or optical recording medium, and statically stores programs and data. The storage unit 30 also stores information such as image advertisement data 31, audio advertisement data 32, audio selection table 33, and target audience history information 34.

The image advertisement data 31 is image data that is displayed on the display device 60, and is still picture or video data for advertising a product or service, for example. The image advertisement data 31 may contain data for a plurality of images.

The audio advertisement data 32 is data for audio that is output from the super-directional speaker 40, and a plurality of types of audio data appropriate to different types of image data contained in the image advertisement data 31 and appropriate to the attributes of the target audience to whom the audio is directed are contained in the audio advertisement data 32.

The audio selection table 33 is a table for selecting the audio to be output from the super-directional speaker 40 from among the audio advertisement data 32, and describes the conditions for determining which audio data to select.

The target audience history information 34 is information for detecting individual differences between the people in the images of people detected from the image captured by the camera 50, and registers the features that are detected in the photographs when the attribute identification unit 22 identifies individual attributes. When the same individual is detected plural times in the images captured by the camera 50, the time that the most recent picture was captured is registered in the target audience history information 34, and an attention flag is set indicating whether or not the person was determined by the face orientation determination unit 21 to be facing the display panel 65 in the most recent picture.

FIG. 4 shows the structure of an example of the audio selection table 33.

Using the sample audio selection table 33 shown in FIG. 4, the audio data is selected based on the type of advertising image displayed on the display device 60, the number of times the target audience has been detected in the images captured by the camera 50, and the attributes of the audience.

More specifically, the corresponding audio data to be projected is set in the audio selection table 33 based on the type of advertising image displayed on the display device 60, the number of times the person has been detected in the image captured by the camera 50, and the attributes of the person (age and sex). For example, if the advertising image displayed on the display device 60 is advertising image A, it is the first time that the person detected by the audio output control unit 23 has been detected in the image captured by the camera 50, and the attributes of the target audience are a male 20 to 30 years old, then audio data A1 is set as the audio data to be used.

The audio output control unit 23 can therefore select the audio data appropriate to the target audience from among the plural audio data files contained in the audio advertisement data 32 based on the type of advertising image displayed on the display device 60 as controlled by the control unit 20, the number of times the person has been detected by the attribute identification unit 22 in the image captured by the camera 50, and the attributes of the person (age and sex) identified by the attribute identification unit 22.

As also shown in FIG. 4, the audio selection table 33 also appropriately correlates the audio data to the attributes when the same target has been detected two or more times. The audio output system 1 therefore outputs different audio from the super-directional speaker 40 according to both the attributes of the identified target and whether it is the first, second, or n-th time that the person was detected in the picture.

FIG. 5 describes an example of the structure of the target audience history information 34.

The target audience history information 34 is a type of database storing information about each person detected by the control unit 20 as an individual image in the image captured by the camera 50.

In this example the target audience history information 34 records an identifier ("ID" herein) automatically assigned by the control unit 20 to each person, the attributes of that person identified by the attribute identification unit 22, features (feature quantity) of the individual image detected by the attribute identification unit 22, the audio data output by the audio output control unit 23 for that person, the attention flag, and the time the picture was taken.

When a single person is detected multiple times in the captured images and audio is output from the super-directional speaker 40 to that person each time the person is detected, information indicating the last audio data that was output is saved as the audio data in the database.

The attention flag is a flag denoting the orientation of the face detected by the face orientation determination unit 21 in the most recent picture. The attention flag is set to ON if the facial orientation is facing the front of the display panel 65, and is set to OFF if the orientation is not towards the front of the display panel 65.

The image capture time in the target audience history information 34 is the time that the picture in which the person was first captured facing the front of the display panel 65 was taken. More particularly, it is the time the picture causing the attention flag for that person to change from OFF to ON was taken.

Using the target audience history information 34, the number of times a particular target is detected in the image captured by the camera 50, and the time that the person was last captured in a picture, can be known.

More specifically, after the attribute identification unit 22 detects the features of the outline of a person in the image captured by the camera 50, the control unit 20 adds a unique ID to the detected features and saves the result in the target audience history information 34. Then after the attribute identification unit 22 detects the features of the outline of a person in the image captured by the camera 50, the control unit 20 determines if information for the image of a person having the same features is already stored in the target audience history information 34. This enables quickly determining if the person detected from the image captured by the camera 50 is a person that was previously detected in an image captured by the camera 50.

The target audience history information 34 is cleared whenever a specific time (such as 30 minutes or 1 hour) has passed since the time the picture was taken. This enables processing a person that has moved out of the area (range G) in which the display device 60 can be seen and later returns within range G as a new target when the person comes back within range G. Considering the possibility of changing the advertisement displayed on the display device 60 and the time span used to evaluate the advertising effect, processing someone as a newly detected target whenever the specified time has passed can be expected to have a better advertising effect and enable more accurately determining the advertising effect than continuing to treat someone that has once been imaged as a target for a long period of time. This also has the advantage of reducing the amount of data stored in the target audience history information 34.

Figure 6:
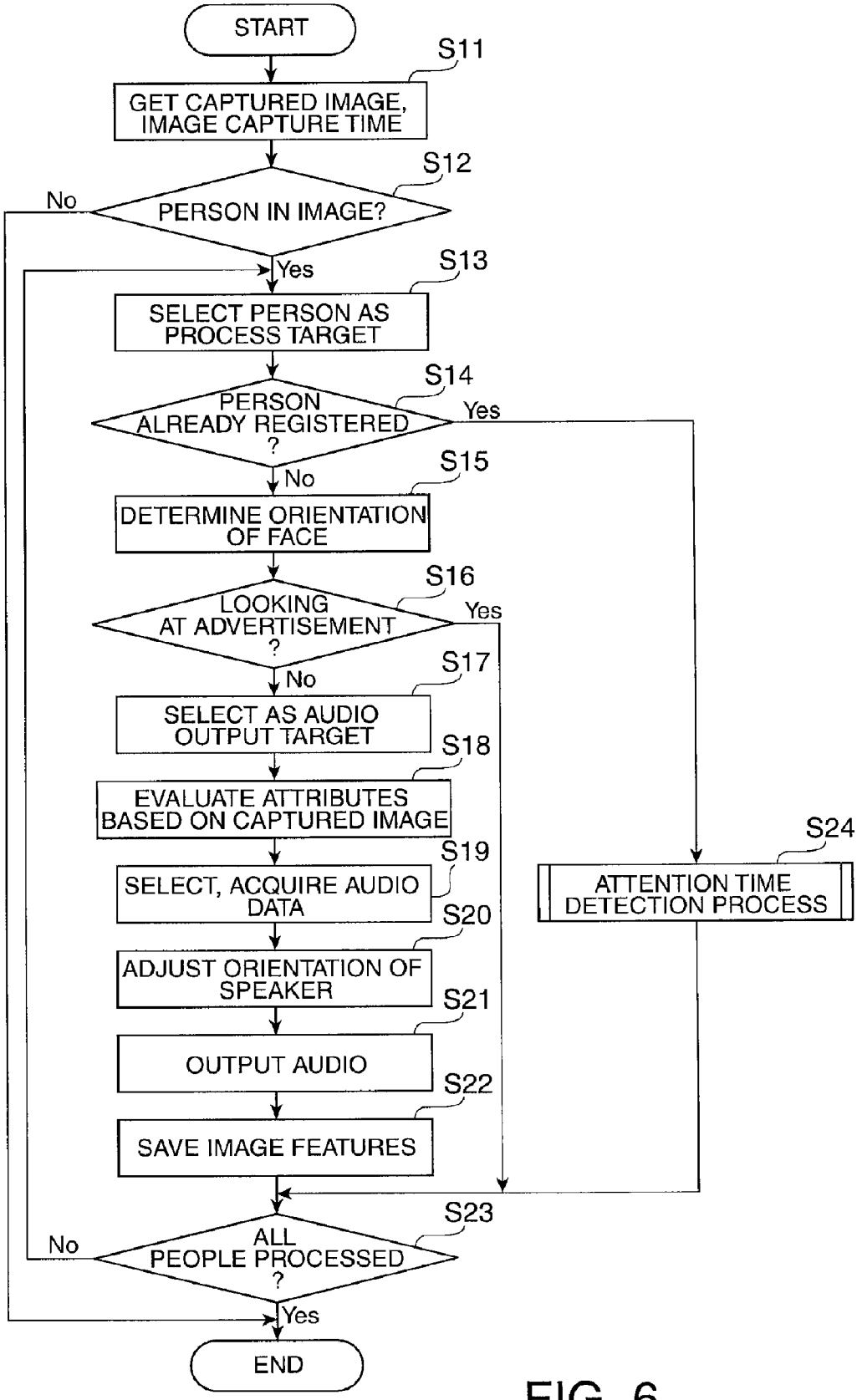
FIG. 6 is a flow chart describing the operation of the audio output system.

FIG. 6 is a flow chart describing the operation of the audio output system 1.

The operation shown in FIG. 6 is executed each time the control unit 20 of the control device 10 samples the image captured by the camera 50 at a specific time interval. When the operation shown in FIG. 6 executes, the control unit 20 functions as the target audience detection unit, audio output control unit, and an attention time detection unit.

The control unit 20 first acquires the image captured by the camera 50 through the interface unit 16 (step S11). The image data acquired here may be still image data or one frame extracted from video data.

The control unit 20 then drives the face orientation determination unit 21 and attribute identification unit 22, and determines if a picture of an outline of a person (an individual picture) is contained in the image captured by the camera 50 (step S12). If a picture of a person is not in the captured image (step S12 returns No), the control unit 20 ends this process.

If a picture of a person is in the captured image, that is, a person was detected (step S12 returns Yes), the control unit 20 selects the picture of one person to be processed as the target audience from among the pictures of all people detected in the captured image (step S13), and determines if this picture is the picture of a person already stored in the target audience history information 34 (step S14). This decision is made by detecting the features of the image of the selected person and determining if a picture having the same features as the detected features is registered in the target audience history information 34.

If the picture of the selected person is not registered in the target audience history information 34 (step S14 returns No), the control unit 20 determines the orientation of the face from the image of the selected target person using the function of the face orientation determination unit 21 (step S15).

If the orientation of the face detected from the image of the target person is facing the front of the display panel 65 (step S16 returns Yes), the control unit 20 goes to step S23 without executing the intermediate steps for outputting audio, for example. More specifically, the control unit 20 does not output audio from the super-directional speaker 40 to people that are already looking at the advertising image displayed on the display panel 65. This is because causing someone that is not looking at the advertising image to hear the audio output from the super-directional speaker 40 is intended to call attention to the advertisement, and this is particularly effective when calling attention to the advertisement is of greatest priority.

If the orientation of the face detected from the image of the target person is not facing the front of the display panel 65 (step S16 returns No), the control unit 20 selects that person as the target audience to whom the audio output of the super-directional speaker 40 is to be directed (step S17), executes the attribute detection process of the attribute identification unit 22 based on the image of that person (step S18), and selects the audio data according to the audio selection table 33 and reads the selected audio data from the audio advertisement data 32 by means of the function of the audio output control unit 23 (step S19).

The control unit 20 then controls the pedestal drive unit 12 by means of the function of the speaker pedestal control unit 24 to adjust the orientation of the super-directional speaker 40 in order to direct the audio output of the super-directional speaker 40 to the target audience selected in step S17 (step S20).

The control unit 20 then causes the super-directional speaker 40 to output the audio by means of the function of the audio output control unit 23 (step S21), registers the features of the individual image detected in step S18 in the target audience history information 34 (step S22), and then goes to step S23.

Whether processing the images of all people detected in the image captured by the camera 50 is completed is then determined in step S23. If processing the images of all people is finished (step S23 returns Yes), this process ends. If there are pictures of people that have not yet been processed (step S23 returns No), control returns to step S13 and the image of another person is selected for processing.

If the image of the person selected for processing in step S13 is the image of a target already registered in the target audience history information 34 (step S14 returns Yes), the control unit 20 executes an attention time detection process for this person (step S24).

Figure 7:
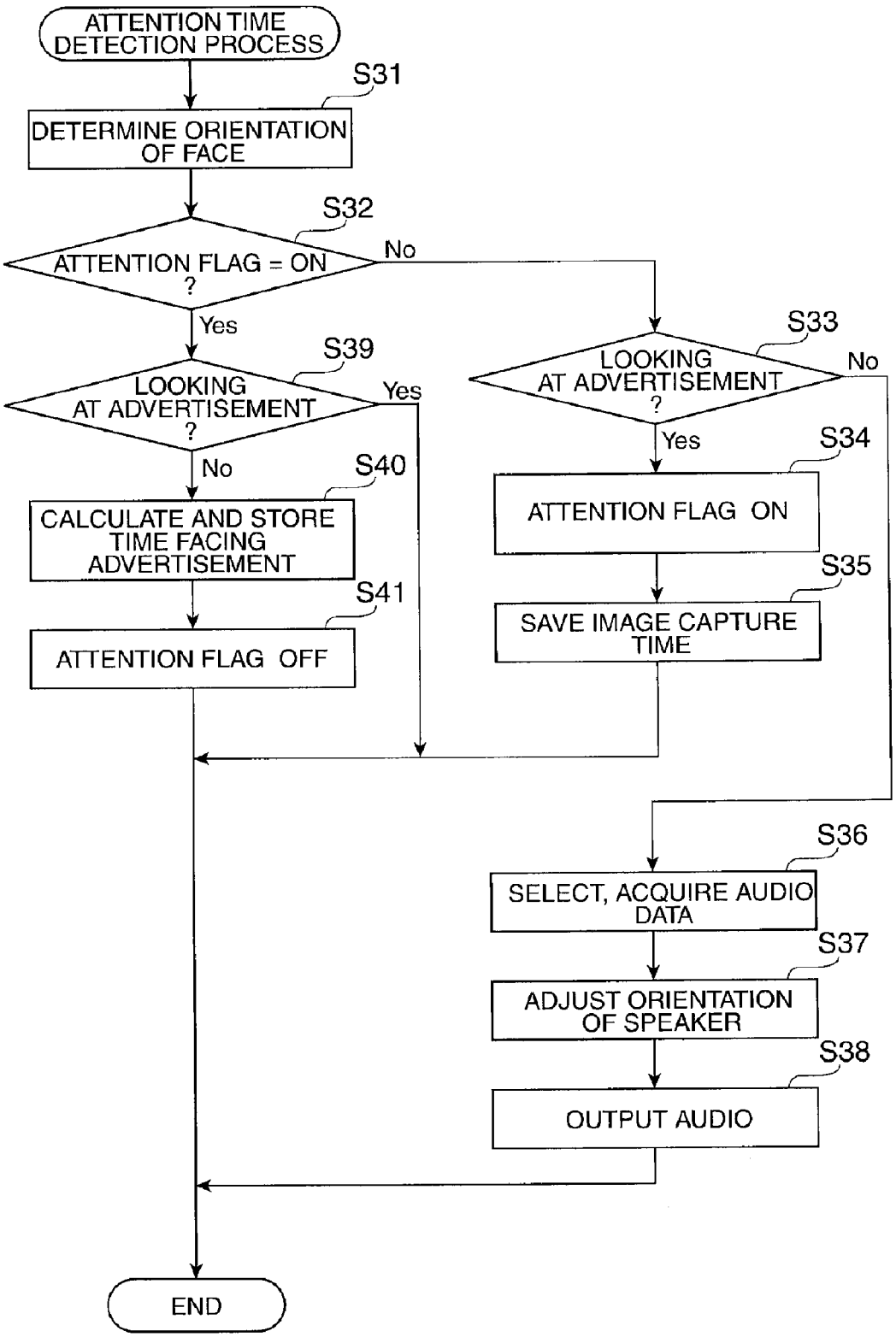
FIG. 7 is a flow chart describing the operation of the audio output system.

FIG. 7 is a flow chart showing the attention time detection process in detail.

In this attention time detection process the control unit 20 uses the function of the face orientation determination unit 21 to determine the orientation of the face of the selected target based on the captured image (step S31).

The control unit 20 then determines if the attention flag for this person is set to ON or OFF in the target audience history information 34 (step S32).

If the attention flag in the target audience history information 34 is OFF (step S32 returns No), the control unit 20 determines if the facial orientation detected by the face orientation determination unit 21 is one of looking at the front of the display panel 65 (step S33). If the face is looking at the display panel 65 (step S33 returns Yes), the control unit 20 sets the attention flag for this person ON in the target audience history information 34 (step S34), writes the image capture time of the image acquired in step S11 (FIG. 6) as the image capture time in the target audience history information 34 (step S35), and control then goes to step S23 in FIG. 6.

If the face is not looking toward the front of the display panel 65 (step S33 returns No), the control unit 20 selects the audio data for this target based on the audio selection table 33 and acquires the selected audio data from the audio advertisement data 32 (step S36). The control unit 20 then controls the pedestal drive unit 12 by means of the function of the speaker pedestal control unit 24 to adjust the orientation of the super-directional speaker 40 in order to direct the audio output of the super-directional speaker 40 to the target audience (step S37).

The control unit 20 then causes the super-directional speaker 40 to output the audio by means of the function of the audio output control unit 23 (step S38), and then goes to step S23.

If the attention flag in the target audience history information 34 is ON (step S32 returns Yes), the control unit 20 determines if the facial orientation detected by the face orientation determination unit 21 is one of looking at the front of the display panel 65 (step S39). If the face is looking at the display panel 65 (step S39 returns Yes), the control unit 20 goes directly to step S23 in FIG. 6.

If the face is not looking toward the front of the display panel 65 (step S39 returns No), the control unit 20 calculates how long the person was looking at the advertisement (step S40). More specifically, because the attention flag was determined to be ON in step S32, the target is considered to have been looking straight at the display panel 65 since the image capture time stored in the target audience history information 34. Because the face is determined in step S39 to not be directed to the front of the display panel 65, this person has stopped looking directly at the display panel 65. The target is therefore determined to have been directing their attention to the front of the display panel 65 from the image capture time stored in the target audience history information 34 until the image capture time of the picture acquired in step S11. In step S40, therefore, the control unit 20 calculates the time from the image capture time saved in the target audience history information 34 to the image capture time of the image captured in step S11, and saves this time in the storage unit 30 as the time that the target directed attention to the display panel 65.

The control unit 20 then turns the attention flag in the target audience history information 34 for this target OFF (step S41), and goes to step S23 in FIG. 6.

The attention time calculation process shown in FIG. 7 detects the image when the orientation of the face of the target changes from facing away from the front of the display panel 65 to facing the front of the display panel 65, and detects the image when the orientation of the face of the target changes from facing the front of the display panel 65 to facing away from the front of the display panel 65, based on the plural images captured with the same person in the picture, and calculates the time that the target (person) was looking at the front of the display panel 65 based on the image capture times of these two pictures.

As described above, the audio output system 1 according to this embodiment of the invention outputs audio from a super-directional speaker 40 to a target person selected from among one or more people in a range from which a display panel 65 displaying an advertisement can be seen, and determines the orientation of the face of the target after the audio is output.

Attention can therefore be drawn to an advertisement by outputting audio, and how long the target pays attention to the advertisement after the audio output can be determined.

Furthermore, by using a super-directional speaker 40, the audio can be output so that it can be heard only by a very small number of people, and attention to the advertisement can be attracted more effectively than if the audio is output so that it can be heard by anyone within a wide range. It is therefore possible to both attract attention to an advertisement by means of audio output using a super-directional speaker 40, and whether the audio output actually attracted any attention to the advertisement, that is, the effectiveness of attracting attention by means of a super-directional speaker 40, can be accurately known.

After outputting audio by means of the super-directional speaker 40, the audio output system 1 determines by means of the control unit 20 how long the face of the target is directed to the display screen of the advertisement after the face of the target is determined to be looking at the front of the display panel 65. More specifically, because the time that the target is paying attention to the display panel 65 is determined, the effect that the audio from the super-directional speaker 40 had on the target can be known precisely.

Because the control unit 20 determines the time starting from when the face of the target changes to an orientation looking directly at the display panel 65 after audio is output by the super-directional speaker 40 until when the orientation of the face of the target then looks away from the front of the display panel 65, the effect of other causes can be substantially eliminated and the direct effect of the audio output by the super-directional speaker 40 can be known.

In addition, the audio output system 1 detects as the target audience from among all people captured in the picture taken by the camera 50 those people whose face is not looking directly at the display panel 65, and outputs audio from the super-directional speaker 40 to the selected target. In other words, because the super-directional speaker 40 outputs audio only to people that are not already looking at the advertisement and does not direct the audio to people that are already looking at the display panel 65, attention can be effectively called to the advertisement. In addition, because the facial orientation after the audio is output by the super-directional speaker 40 is detected, whether the target has actually directed attention to the advertisement can be determined, and the effectiveness of attracting attention by means of the super-directional speaker 40 can be accurately known.

Furthermore, because the audio output system 1 images the area from which the display panel 65 of the display device 60 displaying the advertising image can be seen by means of the camera 50, and outputs audio related to the advertising image being displayed by the display device 60, attention can be focused more powerfully on the advertisement as a result of outputting audio related to the advertising image, and the appeal of the advertisement can be improved.

In addition, when the orientation of the face of a target is determined to not be directed towards the front of the display panel 65 after the audio is output from the super-directional speaker 40, the audio output system 1 outputs audio from the super-directional speaker 40 to that target again, and can thereby even more strongly prompt a person that is not looking at the advertisement to look at the advertisement.

Yet further, because audio that is different from the first audio output is selected according to the audio selection table 33 as the audio output from the super-directional speaker 40 the second and subsequent times audio output is directed to the same person, the target can be urged even more strongly to look at the advertisement.

It will be obvious to one with ordinary skill in the related art that the foregoing embodiment is only one embodiment of the invention and can be modified and improved in many ways without departing from the scope of the accompanying claims.

The foregoing embodiment is described selecting audio data based on the audio selection table 33 according to the attributes of the selected target, but the invention is not so limited. For example, the attributes of the target can be predefined, and audio can be output only to the intended targets when an image of a person matching those attributes is detected. In this configuration, the super-directional speaker 40 is driven to output audio only when the image of a person detected from the image captured by the camera 50 has the attributes that are set as the attributes of the predefined target, and people with attributes other than the predefined attributes will not be made to hear the audio from the super-directional speaker 40. However, because there is little meaning in attracting the attention of people not conforming to the attributes of the desired audience for whom the advertisement is intended, and the advertisement is more effective when attention is drawn from people conforming to the attributes of the desired audience to which the advertisement is directed, attention can be effectively directed to the advertisement.

Yet further, the attribute identification unit 22 is rendered to determine the sex and age of people as the attributes of interest in the foregoing embodiment, the identified attributes are not limited to sex and age. For example, the attribute identification unit 22 may be rendered to differentiate Japanese and foreigners, output Japanese language audio to targets identified as Japanese, and output foreign language audio to people identified as foreigners.

The foregoing is described using a configuration in which a super-directional speaker 40 and camera 50 are disposed to a wall-mounted display device 60, but the invention is not so limited. The super-directional speaker 40 and camera 50 can obviously be disposed to a position separated from the display device 60, and the super-directional speaker 40 and camera 50 may also be disposed to positions separated from each other.

The display device for displaying the advertisements is also not limited to the display panel 65 of a display device 60, and the display device may be a bulletin board on which paper or plastic posters are posted or any other surface on which an advertisement is displayed or presented. Yet further, if the advertisement is drawn directly on a wall, the wall itself may be treated as the advertisement display surface. In this configuration the area from which this wall can be viewed is imaged by the camera 50, the target to be made to hear the audio is selected based on the captured image, and audio can then be output from the super-directional speaker 40 to the selected target.

The number of super-directional speakers 40 and cameras 50 used in the embodiments described above can also be determined as desired. The program executed by the control unit 20 is also not limited to being stored in the storage unit 30 or recorded to a recording medium that can be read by the recording medium reading unit 15, and can be downloaded over a communication connection (not shown in the figure). It will also be obvious to one with ordinary skill in the related art that the configuration of the audio output system 1 can be changed as desired.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An audio output control device that is connected to a directional speaker that outputs audio in a specific direction, and an audio output direction adjustment mechanism that adjusts the audio output direction of the directional speaker, the audio output control device comprising:

an imaging unit that images a specific range from an advertisement display surface;

a target detection unit that detects a person photographed in the image captured by the imaging unit as a target;

an audio output control unit that causes the audio output direction adjustment mechanism to direct the audio output direction of the directional speaker toward the target detected by the target detection unit, and causes the directional speaker to output audio; and an orientation detection unit that determines the orientation of the face of the target based on an image captured by the imaging unit after the directional speaker outputs audio as controlled by the audio output control unit.

2. The audio output control device described in claim 1, further comprising:

an attention time detection unit that determines the time the face of the target was facing toward the advertisement display surface after the orientation detection unit determines the face of the target is facing the advertisement display surface.

3. The audio output control device described in claim 1, wherein:

the audio output control unit selects from among people in the image captured by the imaging unit a person whose face is not facing the advertisement display surface as the target.

4. The audio output control device described in claims 1, wherein:

the imaging unit images a specific range from the display surface of a display device that displays an advertising image as the advertisement display surface; and the audio output control unit outputs audio related to the advertising image displayed by the display device.

5. An audio output control method for an audio output control device that is connected to a directional speaker that outputs audio in a specific direction, and an audio output direction adjustment mechanism that adjusts the audio output direction of the directional speaker, the audio output control method comprising steps of:

imaging an area in front of an advertisement display surface;

detecting a person photographed in the captured image as a target;

causing the audio output direction adjustment mechanism to direct the audio output direction of the directional speaker toward the target, and causing the directional speaker to output audio; and capturing another image after the directional speaker outputs audio and determining the orientation of the face of the target based on this captured image.

6. The audio output control method described in claim 5, further comprising a step of:

determining the time the face of the target was facing toward the advertisement display surface after the orientation detection unit determines the face of the target is facing the advertisement display surface.

7. The audio output control method described in claim 5, wherein:

a person whose face is not facing the advertisement display surface is selected as the target from among the people in the captured image.

8. The audio output control method described in claim 5, further comprising steps of:

imaging a specific range from the display surface of a display device that displays an advertising image as the advertisement display surface; and outputting audio related to the advertising image displayed by the display device.

9. A non-transitory computer readable medium having stored thereon a program that is executed by a computer connected to a directional speaker that outputs audio in a specific direction, and an audio output direction adjustment mechanism that adjusts the audio output direction of the directional speaker, the program when executed causing the computer to perform a method comprising:

imaging a specific range from an advertisement display surface;

detecting a person photographed in the captured image as a target;

causing the audio output direction adjustment mechanism to direct the audio output direction of the directional speaker toward the detected target and causing the directional speaker to output audio; and determining the orientation of the face of the target based on another captured image after the directional speaker outputs the audio.

10. The audio output control device described in claim 1, wherein the audio output control unit causing the audio output direction adjustment mechanism to direct the audio output direction of the directional speaker toward the target detected by the target detection unit comprises causing the audio output direction adjustment mechanism to move relative to the advertisement display surface.

11. The audio output control device described in claim 10, wherein:

the advertisement display surface has a left side and a right side; and causing the audio output direction adjustment mechanism to move relative to the advertisement display surface comprises rotating the audio output direction adjustment mechanism relative to the advertisement display surface in at least one of a left direction, a right direction, an up direction, and a down direction.

12. The audio output control device described in claim 1, wherein the directional speaker is mounted on the audio output direction adjustment mechanism.

13. The audio output control device described in claim 1, wherein:

when the orientation of the face of the target determined by the orientation detection unit indicates that the target is looking at the advertisement display surface, an attention time detection unit determines the time the face of the target was facing toward the advertisement display surface; and when the orientation of the face of the target determined by the orientation detection unit indicates that the target is not looking at the advertisement display surface, the audio output control unit selects one of a plurality of predetermined audio, causes the audio output direction adjustment mechanism to direct the audio output direction of the directional speaker toward the target, and causes the directional speaker to output the selected predetermined audio.

14. The audio output control device described in claim 1, wherein:

when the orientation of the face of the target determined by the orientation detection unit indicates that the target is not looking at the advertisement display surface, an attention time detection unit determines the time the face of the target was facing toward the advertisement display surface; and when the orientation of the face of the target determined by the orientation detection unit indicates that the target is looking at the advertisement display surface, the attention time detection unit does not determine the time the face of the target was facing toward the advertisement display surface.

* * * * *